United States Patent [19]

Akers

[11] Patent Number: 4,570,922

[45] Date of Patent: Feb. 18, 1986

[54] ENVELOPE STACKING ARRANGEMENT FOR MAIL SORTING MACHINES

[75] Inventor: Roy Akers, Olathe, Kans.

[73] Assignee: Bell & Howell Company, Chicago, Ill.

[21] Appl. No.: 505,296

[22] Filed: Jun. 17, 1983

[51] Int. Cl.[4] ..... B65H 29/40; B65H 29/60

[52] U.S. Cl. ..... 271/178; 271/184; 271/215

[58] Field of Search ..... 271/2, 177, 178, 179, 271/180, 181, 184, 213, 214, 215, 303, 307, 3.1

[56] References Cited

U.S. PATENT DOCUMENTS

| | | | |
|---|---|---|---|
| 1,256,975 | 2/1918 | Bigelow et al. | 271/3.1 |
| 2,742,286 | 4/1956 | Williams et al. | 271/305 |
| 3,038,607 | 6/1962 | Eckert | 209/656 X |
| 3,078,089 | 2/1963 | Maidment | 271/279 |
| 3,162,438 | 12/1964 | Perry | 271/214 X |
| 3,260,520 | 7/1966 | Sugden | 274/94 |
| 3,285,389 | 11/1966 | Kaplan | 271/150 X |
| 3,386,574 | 6/1968 | Kaplan | 271/5 X |
| 3,584,869 | 6/1971 | Traphagen | 271/180 |
| 3,735,976 | 5/1973 | Watson | 271/94 |
| 4,019,730 | 4/1977 | Staudinger et al. | 271/181 |
| 4,275,875 | 6/1981 | Akers | 271/5 |
| 4,310,152 | 1/1982 | Mitzel | 271/215 |

OTHER PUBLICATIONS

Edwards, E. G. et al., "Ribbed Roller for Document Stacking", IBM Technical Disclosure Bulletin, vol. 22, No. 4, Sep. 1979, p. 1372.

*Primary Examiner*—Bruce H. Stoner, Jr.
*Assistant Examiner*—James E. Barlow
*Attorney, Agent, or Firm*—Kokjer, Kircher, Bradley, Wharton, Bowman & Johnson

[57] ABSTRACT

A pivotal swing plate for stacking sorted envelopes on edge in the storage section of a high speed mail sorting machine. A sleeve on each swing plate fits on an upright post to pivotally mount the swing plate in the path of incoming sorted envelopes. The swing plate is angled relative to the envelopes and serves both as a side support and back plate for holding the envelopes in a stack. The incoming envelopes progressively pivot the plates open, and a ramp and pin mechanism maintains each swing plate against the leading edges of the envelopes to retain them on edge in the envelope stack.

20 Claims, 5 Drawing Figures

ENVELOPE STACKING ARRANGEMENT FOR MAIL SORTING MACHINES

BACKGROUND AND SUMMARY OF THE INVENTION

This invention relates generally to mail sorting equipment and deals more particularly with an improved storage arrangement for receiving and stacking sorted envelopes in the storage section of a high speed mail sorting machine.

Modern automatic mail sorting machines have recently enjoyed considerable popularity, due largely to their ability to quickly sort the increasingly large volume of mail that must be handled on a daily basis by the postal service, governmental units, large businesses and other institutions. As described in my earlier U.S. Pat. No. 4,275,875, a high speed mail sorting machine typically includes an input section which receives a batch of envelopes to be sorted. The individual envelopes are separated from the stack and delivered one at a time on edge past a code reading device which reads a zip code or bar code printed on the envelope. The envelopes are then conveyed to a storage section of the machine and directed into sorting bins under the control of electronic circuitry which operates to route each envelope into a bin determined by the particular code detected by the code reader.

In this fashion, envelopes having the same code are directed into the same bin or bins. Often, outgoing mail is sorted according to zip code so that envelopes having a common destination are collected in the same bin or bins. Also, incoming mail can be routed to the proper department within a multiple department business or institution by properly sorting the incoming envelopes according to codes representative of the various departments.

In the past, mail sorting machines have been equipped with a large number of sorting bins which may be arranged along opposite sides of the envelope track through which the envelopes are conveyed in the bin section of the machine. As shown in my aforementioned U.S. Pat. No. 4,275,875, each bin typically has opposite side walls and a spring loaded back plate which travels back and forth along a shaft as envelopes are deposited in or removed from the bin. The back plate functions to hold the envelopes upright on their edges in cooperation with the side wall of the bin.

Although this type of arrangement has functioned in a satisfactory manner for the most part, it is relatively expensive because of the special components that are required. It is necessary for the back plate to move back and forth freely in order to avoid presenting undue resistance to the incoming envelopes and possibly jamming the machine. To provide the requisite freedom of movement, each back plate must have a low friction bearing, and each shaft must be specially machined and hardened. Both of these special items add significantly to the overall cost of the mail sorting machine. The contribution that these special components make to the expense can be readily appreciated when it is recognized that each bin requires one special shaft and two special bearings. In a machine having a large number of bins, the added cost takes on particular significance.

In addition to the expense, the sliding back plate arrangement requires in each bin a pair of upstanding side walls, a back wall, a shaft extending the entire length of the bin, and a spring loaded back plate extending across the bin. All of these parts can obstruct access to the sorting bins for removal of the mail and can significantly increase the time that is involved in removing mail from the bins. A related problem is that the bins occupy the entirety of the available surface area in the bin section of the machine, and there is no vacant and unobstructed space available to temporarily placing a mail tray or other object.

The present invention is aimed at eliminating these problems and has, as its principal goal, the provision of a more economical storage arrangement for receiving and stacking the sorted envelopes in a mail sorting machine. In addition to its economy, the storage arrangement of the present invention eliminates most of the components that obstruct access to the envelopes in conventional sorting bins. Moreover, the compact configuration of the stacking device provides ample table surface availability for the receipt of mail trays and the like.

In accordance with the invention, each storage area is equipped with a swing plate which is mounted to swing on an upright post. Each swing plate is located in the path of the incoming envelopes. As the envelopes enter the storage area, their front edges encounter the front face of the swing plate and progressively pivot it about the post as additional envelopes are deposited in the storage area. The swing plate is arranged at an acute angle relative to the envelopes and thus serves both as a back plate and as a side plate which is capable, by itself, of supporting the sorted envelopes in a progressively increasing stack.

Each swing plate has a sleeve which is fitted on the post and which has an inclined ramp on its lower edge. As the swing plate is progressively pivoted open by the incoming envelopes, the ramp rides along a roll pin that projects from the post. This raises the swing plate and causes it to be continuously urged toward the envelopes under the influence of gravity. The ramp and roll pin arrangement thereby assures that each swing plate is maintained against the leading edges of the envelopes which are stacked against it.

The swing plate arrangement of the present invention eliminates the need for bin side walls and back walls and for the spring loaded back plate and associated components that have previously been used in the bins of mail sorting machines. Consequently, the present invention is not only significantly improved in its economy, but it also eliminates the structure which in the past has obstructed access to the stacked mail and occupied all of the useful surface area in the storage section of the machine. At the same time, the storage arrangement of the present invention provides virtually the same storage capacity as the more expensive storage system that has been prevalent heretofore.

DETAILED DESCRIPTION OF THE INVENTION

In the accompanying drawing which forms a part of the specification and is to be read in conjunction therewith and in which like reference numerals are used to indicate like parts in the various views.

Figure 1:
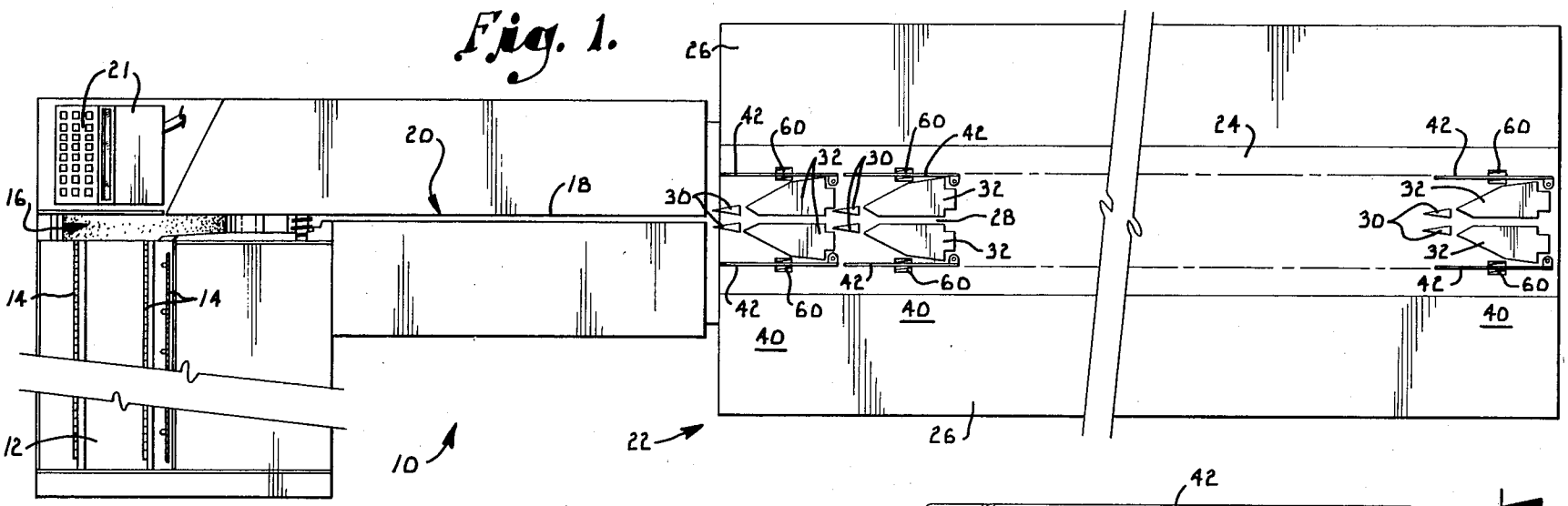
FIG. 1 is a top plan view of a high speed mail sorting machine equipped with an envelope storage arrangement constructed according to a preferred embodiment of the present invention, with the break lines indicating continuous length of the magazine and storage sections of the machine.

Referring now to the drawing in more detail and initially to FIG. 1, numeral 10 generally designates a high speed mail sorting machine of the same general type disclosed in U.S. Pat. No. 4,275,875 which issued on June 30, 1981 to Roy Akers and which is incorporated by reference herein. As disclosed in the aforementioned patent, the mail sorting machine 10 includes an input section in the form of a magazine 12 which receives the envelopes that are to be sorted. The magazine section 12 includes a feeder having a plurality of drive chains 14 which operate to deliver the envelopes one at a time to pick off station generally indicated at 16. At the pick off station 16, a pick off device separates the individual envelopes from the mail stack and conveys them one at a time into a guideway 18 extending past a read station 20. The envelopes are conveyed on edge through the guideway 18, and a code reading device (not shown) reads a code imprinted on the envelopes and operates the sorting circuitry in accordance with the codes that are read. The mail sorting machine includes a key board 21 which permits data and instructions to be entered.

Downstream from the guideway 18, the mail sorting machine 10 includes a storage section which is generally designated by numeral 22. The storage section receives the sorted envelopes and includes a horizontal panel 24 which extends centrally along the entire length of the storage section. A pair of horizontal tables 26 are secured to the opposite sides of the central panel 24 and are located in the same plane as the panel to essentially form side extensions thereof.

Figure 2:
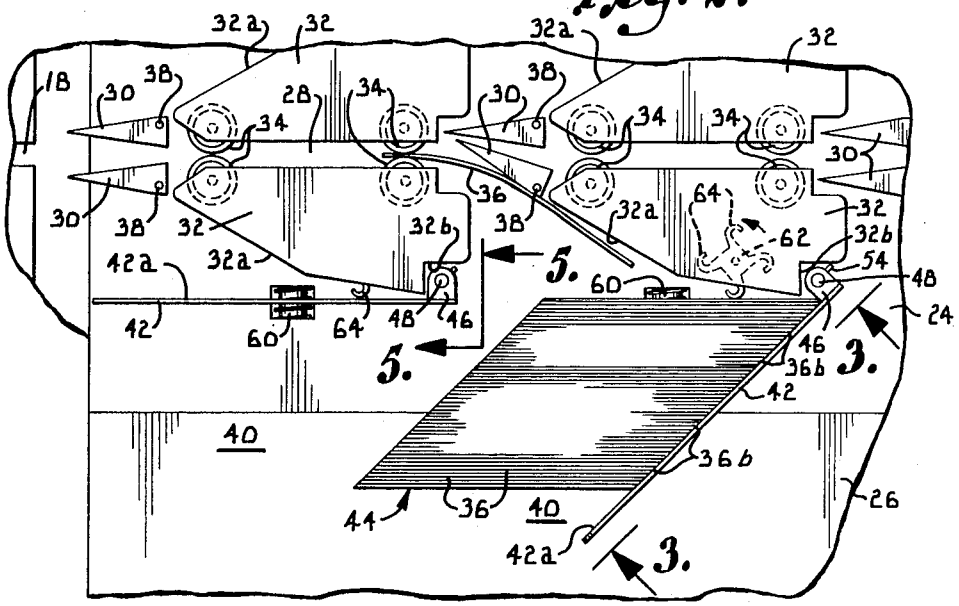
FIG. 2 is a fragmentary top plan view on an enlarged scale showing a pair of adjacent storage areas of the machine.

Referring now additionally to FIG. 2, the envelopes which are delivered to the storage section 22 of the mail sorting machine are conveyed on edge into a letter track 28 which is formed between opposing sets of diverter gates 30 and guide plates 32. Each set of guide plates 32 includes a plurality of stacked plates located on opposite sides of the letter track 28. Each plate 32 has a guide surface **32*a* which is angled relative to the letter track 28 to assist the gates 30** in properly routing the letters.

Driven friction wheels 34 project into the envelope track 28 from between the guide plates 32 and engage opposite sides of the envelopes 36 to convey them along the track 28 and between the successive sets of gates 30 and guide plates 32. The envelopes 36 are conveyed through the letter track 28 in a vertical orientation with a lower edge **36*a* of each envelope travelling along the central panel 24 which underlies the letter track. Each envelope has a leading edge 36*b*** which is oriented vertically as the envelope is conveyed through the letter track.

The diverter gates 30 are controlled by the electronic sorting circuitry of the machine. Each set of gates is pivotally mounted on a vertical shaft 38 and is normally in the position shown for the initial two gates 30 located at the lefthand side of FIG. 2. In this normally open position, the gates 30 permit the envelope 36 to pass between them toward the next set of diverter gates. The code imprinted on each envelope corresponds to a particular storage area of the machine, and when the envelope reaches the storage area to which its code corresponds, the corresponding diverter gate 30 is pivoted to the closed position shown for the lower gate in the second set of gates of FIG. 2. When the gate is closed, it blocks the letter track 28 and deflects the envelope to one side, thereby diverting the envelope from the letter track 28 and into the storage area corresonding to the gate. The individual storage areas which receive the envelopes are generally designated by numeral 40. The storage areas 40 extend continuously along opposite sides of the letter track 28.

In accordance with the present invention, each storage area 40 is provided with a swing plate 42 which serves to support the incoming envelopes in a neatly arranged stack such as the stack indicated by numeral 44 in FIG. 2. The swing plate 42 for each storage area 40 is constructed and functions in the same manner.

Figure 3:
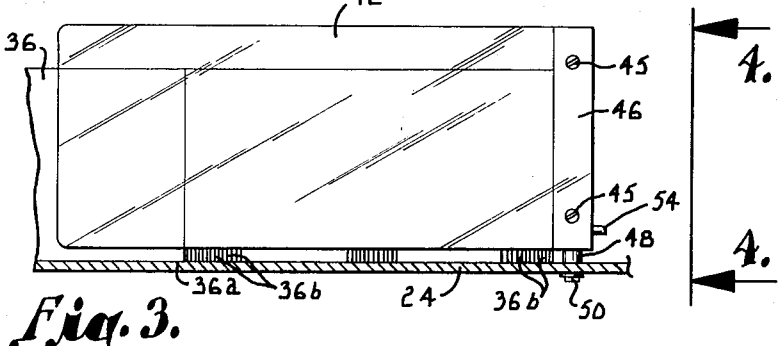
FIG. 3 is a fragmentary view on an enlarged scale taken generally along line 3—3 of FIG. 2 in the direction of the arrows.

As best shown in FIG. 3, a pair of screws 45 secure one end portion of each swing plate 42 to a flat surface formed on a vertical sleeve 46. Each sleeve 46 is bored and fitted on a vertical post 48 having its lower end secured by a screw 50 to the horizontal panel 124 which underlies the envelope track 28. The posts 48 are located in notched areas **32*b* of the guide plate assemblies 32. The sleeves 46 are received on the posts 48 in a manner permitting each swing plate 42 to pivot about the vertical axis of its post between the fully closed position shown for the initial or left swing plate 42** in FIG. 2 and the fully open position shown for the second or right swing plate in FIG. 2.

Each swing plate 42 has a vertical attitude at all times. The front face **42*a* of each swing plate is a flat surface which occupies a vertical plane and confronts the incoming envelopes which are deflected into the corresponding storage area 40. Preferably, the swing plates 42 are constructed of transparent plastic or a similar material. The sleeves 46 are preferably metal, as are the posts 48**.

The lower edge of each sleeve 46 has a special configuration which provides an inclined ramp 52. Each post 48 has a horizontal roll pin 54 projecting from its lower end portion a short distance above the underlying panel 24. The ramp 52 of each sleeve rides on the roll pin 54. At the lower end of the ramp 52, each sleeve has a vertical edge forming a stop 56 which engages the side of pin 54 to limit movement of the swing plate 42 in one direction.

Figure 5:
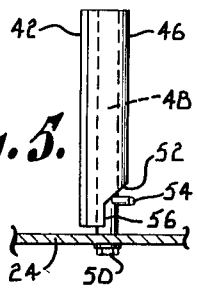
FIG. 5 is a fragmentary view on an enlarged scale taken generally along line 5—5 of FIG. 2 in the direction of the arrows.
Figure 4:
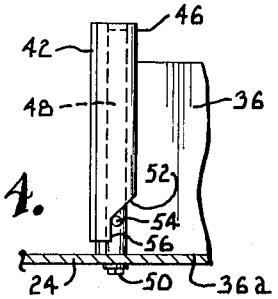
FIG. 4 is a fragmentary view taken generally along line 4—4 of FIG. 3 in the direction of the arrows.

When swing plate 42 is in the fully closed position, it extends parallel to the letter track 28, and an elevated portion of ramp 52 engages the top of pin 54, as shown in FIG. 5. At this position, sleeve 46 is in its lowermost position, and swing plate 42 is stable. In the fully open position shown in FIGS. 3 and 4, the lowermost portion of ramp 52 is on top of pin 54 and the stop surface 56 is against one side of the pin to prevent the swing plate from opening further. At this position, the swing plate is unstable because the weight of the swing plate and sleeve tends to lower the swing plate, causing ramp 52 to ride down on pin 54 to lower the sleeve 46. The ramp and roll pin arrangement continously urges each swing plate 42 away from the open position and toward the closed position under the influence of gravity. The swing plate 42 pivots through an arc of approximately 45° between the open and closed positions, although other ranges of pivotal movement are possible.

In operation of the mail sorting machine, the envelopes 36 that are diverted by gates 30 from the letter track 28 are guided by guide surfaces 32*a*, into the corresponding storage areas 40 and toward the front faces 42*a* of the swing plates. As each envelope enters its storage area, it is intercepted by the swing plate 42 for that particular storage area. If there are no envelopes or only a few envelopes in the storage area, swing plate 42 is at or near the fully closed position. As the envelope 36 encounters surface 42*a* of the swing plate 42, it pivots the swing plate slightly away from the closed position and, as additional envelopes are received, their leading edges 36*b* successively encounter surface 42*a* and force the swing plate to progressively pivot toward the open position. The incoming envelopes build up on edge in a stack 44 which is supported by the swing plate. Eventually, the swing plate 42 is pivoted to the fully open position, and the stack 44 of sorted mail should then be removed. Panel 24 and the table surface 26 cooperate to form a horizontal floor which receives the lower edges of the envelopes in each storage area 40.

The mail sorting machine includes a driven grooved roller 60 for each storage area which projects upwardly from beneath panel 24 and has grooves oriented generally parallel to the letter track to receive the lower edges of the envelopes. The rollers 60 assist in maintaining the envelopes vertical and parallel to the envelope track 28. Additionally, the mail sorting machine includes a plurality of rotary beater wheels 62 each having a plurality of curved fingers 64. Each beater wheel 62 is driven in the appropriate direction to cause its curved fingers 64 to engage one side of each envelope to urge the envelope outwardly toward the stack and forwardly toward the swing plate 42. In this manner, the grooved rollers 60 and beater wheels 62 assist in maintaining the envelopes stacked against the swing plates 42. Rollers 60 and beater wheels 62 can be driven in any suitable manner, such as by the same drive system that powers wheels 34.

The swing plates 42 are maintained at an acute angle with respect to the envelopes 36. As a result, the swing plates 42 engage the front edges 36*b* of the envelopes and at the same time serve as a back plate to prevent the envelopes from falling backwards away from the letter track 28. As the swing plate is progressively pivoted toward the fully open position, its angle relative to the envelopes progressively increases. If the swing plate is pivoted significantly past the fully open position, the leading envelopes can fall backwards off of its envelope confronting surface 42*a*. Accordingly, it is desirable to provide the stop 56 in order to prevent the swing plate from pivoting beyond the fully open position and possibly causing the entire envelope stack to topple. If the swing plate is completely full such that it receives envelopes along the entirety of its front face 42*a*, the envelope stack should be removed. If it is not, additional incoming envelopes simply displace the back envelopes off of the swing plate rather than jamming the machine or toppling the entire stack 44.

Due to the acute angle of the swing plate 42 relative to the envelopes, the leading edges 36*b* of the envelopes are staggered as the stack 44 builds up. The swing plate maintains each envelope in the stack 44 in a vertical plane with its leading edge 36*b* oriented vertically. Consequently, the stack 44 is compact and neatly arranged with the envelopes remaining parallel to one another and to the envelope track 28.

The adjacent swing plates 42 are separated far enough that they do not obstruct or otherwise interfere with one another. It is noted that there are no components other than the swing plates 42 immediately adjacent to the envelopes, and there is thus no structure which significantly obstructs access to the storage areas 40 for removal of the stacked envelopes. It is also noted that there is significant available space on the tables 26 beyond the free ends of the swing plates so that conveniently accessible surfaces are provided for temporarily placing mail trays and other objects.

It is thus evident that the swing plate arrangement of the present invention provides an inexpensive and compact envelope stacking system for the storage section of a high speed mail sorting machine. Without sacraficing storage capacity or reliability, additional table space is also provided and complicated and obstructive components are eliminated.

From the foregoing, it will be seen that this invention is one well adapted to attain all the ends and objects hereinabove set forth together with other advantages which are obvious and which are inherent to the structure.

It will be understood that certain features and subcombinations are of utility and may be employed witout reference to other features and subcombinations. This is contemplated by and is within the scope of the claims.

Since many possible embodiments may be made of the invention without departing from the scope thereof, it is to be understood that all matter herein set forth or shown in the accompanying drawing is to be interpreted as illustrative and not in a limiting sense.

Having thus described the invention, I claim:

1. An envelope storage arrangement for a mail sorting machine having means for conveying envelopes one at a time along an envelope track with the envelopes oriented generally vertically and means for directing selected envelopes along a predetermined path from the envelope track into a storage area, said storage arrangement comprising:

a generally horizontal surface forming a floor of the storage area for receiving lower edges of the incoming envelopes;

a substantially planar swing plate mounted in the path of the incoming envelopes for pivotal movement about a substantially vertical axis between a first position when the storage area is empty and a second position when the storage area is full, said plate in the first position thereof being oriented generally parallel to envelopes entering the storage area and said plate being progressively pivoted toward the second position by incoming envelopes and having an envelope confronting surface located to intercept incoming envelopes and to maintain the envelopes in a stack with a leading edge of each envelope engaging said envelope confronting surface and being maintained thereby in a generally vertical orientation, said plate having an end remote from said axis which moves away from the envelope track as the plate is pivoted toward the second position; and means for urging said swing plate toward the first position to maintain said envelope confronting surface against the leading edges of the envelopes stacked against said swing plate in the storage area.

2. The invention of claim 1, including rotatable beater means for urging the envelopes toward said swing plate.

3. The invention of claim 1, including:

a generally upright post on said floor providing said axis; and a sleeve on said swing plate received on said post and pivotal about the post to mount said swing plate on the post for pivotal movement thereon.

4. The invention of claim 3, wherein said urging means includes:

a pin projecting from said post; and an inclined ramp surface on said sleeve engaging said pin in a manner to raise the sleeve on said post as the swing plate is pivoted away from the first position, whereby the influence of gravity urges the swing plate toward the first position.

5. The invention of claim 4, including a stop on said sleeve located to contact said pin to prevent pivotal movement of the swing plate beyond the second position.

6. The invention of claim 1, wherein said urging means includes:

a stationary pin on the machine; and an inclined ramp surface on said swing plate riding on said pin to raise the swing plate as same moves away from the first position toward the second position, thereby continuously urging said swing plate toward the first position under the influence of gravity.

7. The invention of claim 6, including a stop on said swing plate located to contact said pin to prevent the swing plate from pivoting beyond the second position.

8. The invention of claim 1, including a grooved roller on the machine adjacent said floor at a location to underlie the incoming envelopes, said roller providing assistance in maintaining each incoming envelope in a vertical orientation.

9. The invention of claim 8, including a rotatable beater member on the machine having a plurality of projecting fingers for contacting each incoming envelope on one side thereof to maintain the envelope against the stack with the leading edge of the envelope against said envelope confronting surface of the swing plate.

10. The invention of claim 1, wherein said urging means includes inclined ramp means for raising said swing plate progressively as same is progressively pivoted away from the first position toward the second position, whereby the swing plate is urged toward the first position and away from the second position under the influence of gravity.

11. In a mail sorting machine having means for conveying envelopes one at a time along an envelope track with a leading edge of each envelope maintained in a substantially vertical orientation, a plurality of storage areas for receiving sorted envelopes, and means for selectively directing the envelopes into the storage areas, the improvement comprising:

a swing plate for each storage area, each swing plate having a substantially flat surface located in a generally vertical plane in the path of the incoming envelopes entering the corresponding storage area, whereby to intercept the incoming envelopes;

means for mounting each swing plate on the mail sorting machine in a manner permitting the plate to swing about a substantially vertical pivot axis between a first position when the corresponding storage area is empty and a second position when the storage area is full, each swing plate being progressively pivoted away from the first position toward the second position by incoming envelopes and the flat surface of each swing plate receiving the leading edges of the envelopes in a manner to retain the envelopes in a stack with each envelope maintained in a generally vertical plane offset from the plane of the flat surface of the swing plate; and means for urging each swing plate away from the second position toward the first position to maintain the flat surface of the swing plate against the leading edges of the envelopes to retain the envelopes in a stack, said urging means including inclined ramp means for raising the swing plate progressively as same is progressively pivoted away from the first position toward the second position, whereby the influence of gravity continuously urges said swing plate away from the second position and toward the first position.

12. The improvement of claim 11, including stop means for preventing pivotal movement of said swing plate beyond the second position.

13. The improvement of claim 11, wherein said mounting means includes:

a generally upright post for each storage area; and a sleeve on each swing plate, said sleeves being fitted on the respective posts in a manner permitting each swing plate to pivot about the corresponding post between the first and second positions.

14. The improvement of claim 13, wherein said urging means includes:

a pin projecting from each post; and an inclined ramp on each sleeve riding up on the corresponding pin as the sleeve is turned on the post in a direction to pivot the swing plate away from the first position toward the second position, thereby raising the swing plate to effect urging of the swing plate away from the second position and toward the first position under the influence of gravity.

15. The improvement of claim 14, including a stop on each sleeve located adjacent said ramp to engage the corresponding pin in a manner preventing the swing plate from pivoting beyond the second position.

16. In a mail sorting machine having means for conveying envelopes one at a time along an envelope track with each envelope having a substantially vertical leading edge and a substantially horizontal lower edge moving on a support surface, a plurality of discrete storage areas for receiving sorted envelopes, and means for selectively diverting the envelopes out of the envelope track and into the storage areas along predetermined paths, an improved envelope storage arrangement comprising:

a generally horizontal floor for each storage area adapted to receive the lower edges of incoming envelopes;

an upright post on each floor;

a swing plate for each post having a sleeve received on the corresponding post for up and down movement thereon and pivotal movement thereon to mount the corresponding swing plate on each post for swinging movement about the axis thereof in opposite directions, each post being located to position an envelope confronting surface of the corresponding swing plate in the path of the incoming envelopes whereby the incoming envelopes progressively pivot each swing plate in one direction and build up in a stack with the lower edges of the envelopes on the floor and leading edges of the envelopes disposed against said envelope confronting surface to hold the envelopes upright; and inclined ramp means for progressively raising each sleeve on the corresponding post as the sleeve pivots in said one direction, whereby the influence of gravity opposes said ramp means to maintain said envelope confronting surfaces against the leading edges of the envelopes deposited in the storage areas.

17. The invention of claim 16, including stop means for limited swinging movement of each swing plate in said one direction.

18. The invention of claim 16, wherein said ramp means includes:

a pin projecting from each post; and a lower edge of each sleeve having an inclined ramp surface thereon riding on the corresponding pin in a manner to progressively raise the sleeve on the post as the sleeve is pivoted in said one direction on the post.

19. An envelope storage arrangement for a mail sorting machine having means for conveying envelopes one at a time along an envelope track with the envelopes oriented generally vertically and means for directing selected envelopes along a predetermined path from the envelope track into a storage area, said storage arrangement comprising:

a generally horizontal surface forming a floor of the storage area for receiving lower edges of the incoming envelopes;

a substantially planar swing plate mounted in the path of the incoming envelopes for pivotal movement about a substantially vertical axis between a first position when the storage area is empty and a second position when the storage area is full, said plate being progressively pivoted toward the second position by incoming envelopes and having an envelope confronting surface located to intercept incoming envelopes and acting to maintain the envelopes in a stack with a leading edge of each envelope engaging said envelope confronting surface and being maintained thereby in a generally vertical orientation, said plate defining progressively increasing angles relative to the planes of the envelopes in the stack as the plate is progressively pivoted toward the second position by incoming envelopes; and means for urging said swing plate toward the first position to maintain said envelope confronting surface against the leading edges of the envelopes stacked against said swing plate in the storage area.

20. The invention of claim 19, wherein said urging means is gravity operated.

* * * * *